US005752608A

United States Patent [19]

Dingeldein

[11] Patent Number: 5,752,608

[45] Date of Patent: May 19, 1998

[54] SPACER RACK FOR STACKING WHEEL RIMS

[75] Inventor: Gero Dingeldein, Reichelsheim, Germany

[73] Assignee: Koenig Investment Group International Inc., Alberta, Canada

[21] Appl. No.: 387,771

[22] PCT Filed: Aug. 11, 1993

[86] PCT No.: PCT/EP93/02128

§ 371 Date: Mar. 28, 1995

§ 102(e) Date: Mar. 28, 1995

[87] PCT Pub. No.: WO94/04429

PCT Pub. Date: Mar. 3, 1994

[30] Foreign Application Priority Data

Aug. 20, 1992 [DE] Germany ..... 42 27 524.5

[51] Int. Cl.[6] ..... A47F 5/00

[52] U.S. Cl. ..... 211/23; 211/194; 211/59.4

[58] Field of Search ..... 211/23, 59.4, 49.1, 211/74, 194

[56] References Cited

U.S. PATENT DOCUMENTS

| | | | |
|---|---|---|---|
| 2,912,139 | 11/1959 | Talley . | |
| 3,664,497 | 5/1972 | Mascia | 211/74 X |
| 4,593,818 | 6/1986 | Schenkman . | |

FOREIGN PATENT DOCUMENTS

| | | |
|---|---|---|
| 0 165 183 | 12/1985 | European Pat. Off. . |
| 2 573 395 | 5/1986 | France . |
| 90/05677 | 5/1990 | WIPO . |

*Primary Examiner*—Robert W. Gibson, Jr.
*Attorney, Agent, or Firm*—Burns, Doane, Swecker & Mathis, L.L.P.

[57] ABSTRACT

A spacer rack for stacking wheel rims includes a plurality of plastic rim holders interconnected with one another in coplanar relationship. Each rim holder includes a vertical, circular positioning edge arid a spacer ring projecting inwardly from the positioning edge. The positioning edge projects upwardly and downwardly beyond the spacer ring to define the outer peripheries of wheel rim-receiving areas. Each rim holder includes outer flanges that are connected to the outer flanges of other rim holders.

13 Claims, 4 Drawing Sheets

SPACER RACK FOR STACKING WHEEL RIMS

BACKGROUND OF THE INVENTION

The present invention relates to a spacer rack for use in stacking wheel rims. Wheel rims used for motor vehicles, in particular wheel rims made of light alloy, are vulnerable to surface damage, and for this reason must be protected during transportation and storage. Packing such rims individually in cartons is relatively costly; in addition, the rims must be removed from the packaging in the sales room in order that the customer can see the rims.

If it is intended that the rims be transported and stored when stacked on pallets, it is essential to install spacers between the individual layers of the stack so as to prevent the rims from contacting each other and becoming damaged thereby. In addition, strapping or similar packaging measures must be used in order to ensure that the wheel rims making up the stack cannot shift sideways. The packaging effort that is required in order to do this is relatively great, especially because the packaging material that is used, such as corrugated cardboard, paper, or wooden frames, must be disposed of since it is either impossible or too costly to re-use it. This situation is exacerbated in that the mechanical demands made on the spacers are extremely high because the wheel rims, which are usually made in one piece with the wheel dishes, are relatively heavy; there are large load peaks for the spacers between the narrow edgers of the wheel rim that lie above each other, in particular if the wheel rims that lie one above the other shift relative to each other.

For this reason, it is the task of the present invention to create a spacer rack for stacking wheel rims, which makes it possible to form stable stacks of wheel rims without the danger that the wheel rims themselves will damage each other. The spacer racks should be easy to handle and be of only light weight; they should be suitable for repeated re-use and also permit the material used in them to be recycled.

SUMMARY OF A PREFERRED EMBODIMENT OF THE INVENTION

According to the present invention, this problem has been solved in that the spacer rack incorporates a plurality of rim holders that are of plastic, each of these consisting of a circular spacer ring and a projecting positioning edge that extends upward and downward.

Because of the precise and effective positioning of the wheel rims that lie one above the other, it is ensured that the forces that are to be transferred are distributed evenly over the whole edge of the wheel rim, so that unacceptably high stress peaks are avoided. In addition, compared to cardboard and similar materials, the plastic can withstand far greater loads so that the rims that lie one above the other cannot damage each other.

The amount of material used is relatively small because the rim holders are annular and are arranged only in the areas between wheel rims that lie above each other where proper spacing and centering are required, namely, in the area of the wheel rim edges. The rim holders can be installed singly between each two wheel rims that lie above each other in order to form a stack of four wheel rims one above the other, for example.

Because of their light weight, and because they take up very little room and are highly resistant to wear, the rim holders can be returned from the dealer to the manufacturer of the wheel rims at very little cost, and can thus be re-used. Because they are manufactured from plastic, all of the material can be recycled; the rim holders are chopped up and converted to plastic granulate and this can then be re-used in the manufacturing process.

According to a preferred embodiment of the present invention, provision is made such that a plurality of rim holders that lie in a common plane are connected to each other on their peripheries to form a mesh. This results in assembled spacer racks for large stacks of rims, when each layer of the stack comprises a plurality of wheel rims. Because the rim holders are joined to each other, all the wheel rims in one layer will be exactly aligned and at the same time all of the wheel rims that are lying one above the other will be precisely positioned. This means that a stack of rims of far greater stability will be formed and which can withstand the lateral forces that occur during transportation without becoming disordered. The stack that is formed in this way and which rests, for example, on a pallet, can also be picked up by handling and conveying machinery and then moved without the danger that the wheel rims will change position within the stack.

The meshes, which are formed from a plurality of rim holders are both light and flexible and for this reason can be easily manipulated by one person. In order to form a stack of wheel rims as a transportation or storage unit, all that will be required in addition to the rim holders that have been joined together to form the mesh will be a base pallet and a cover plate, and these are usually of wood. The stackable unit that is formed thereby can be transported and stored. There is no need for any additional packaging material such as corrugated cardboard, paper, foam, and wooden structures.

Because of the fact that the rim holders are in the form of circular rings and are thus completely open at the center, it is also possible for them to accommodate wheel rims having wheel dishes that extend beyond the wheel rim edges on one side.

In order to simplify mutual attachment of the rim holders within a mesh, in one development of the concept of the present invention provision is made such that the rim holders on several points around their periphery have a rim edge that projects beyond the centring edge, at which they are connected to the adjacent rim holders.

It is preferred that adjacent rim holders be joined together by means of connectors that overlap the edges of the flange. It has been found to be particularly advantageous that these connectors are also of plastic and welded to the rim holders. This means that no other material is required for this mutual connection. The whole of the mesh consists of plastic and is thus suitable for recycling. However, instead of this, it is also possible that the rim holders be rivetted or screwed to each other or to the connectors.

BRIEF DESCRIPTION OF THE DRAWINGS

One embodiment of the present invention will be described in greater detail below on the basis of the drawings appended hereto. These drawings show the following.

DETAILED DESCRIPTION OF A PREFERRED EMBODIMENT OF THE INVENTION

Figure 1:
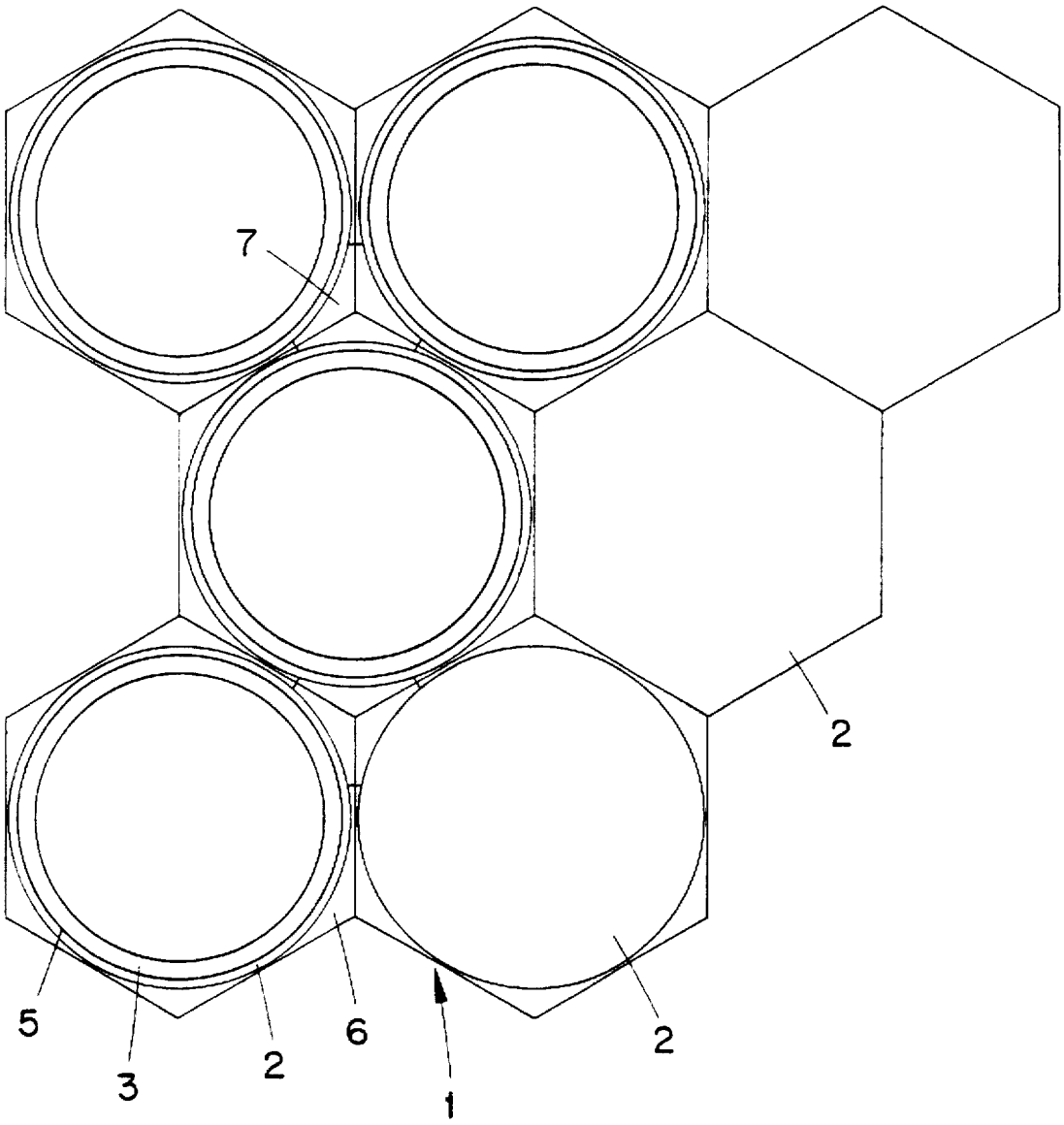
FIG. 1: a plan view of a plurality of rim holders joined together to form a mesh as a spacer rack for stacks of wheel rims.
Figure 3:
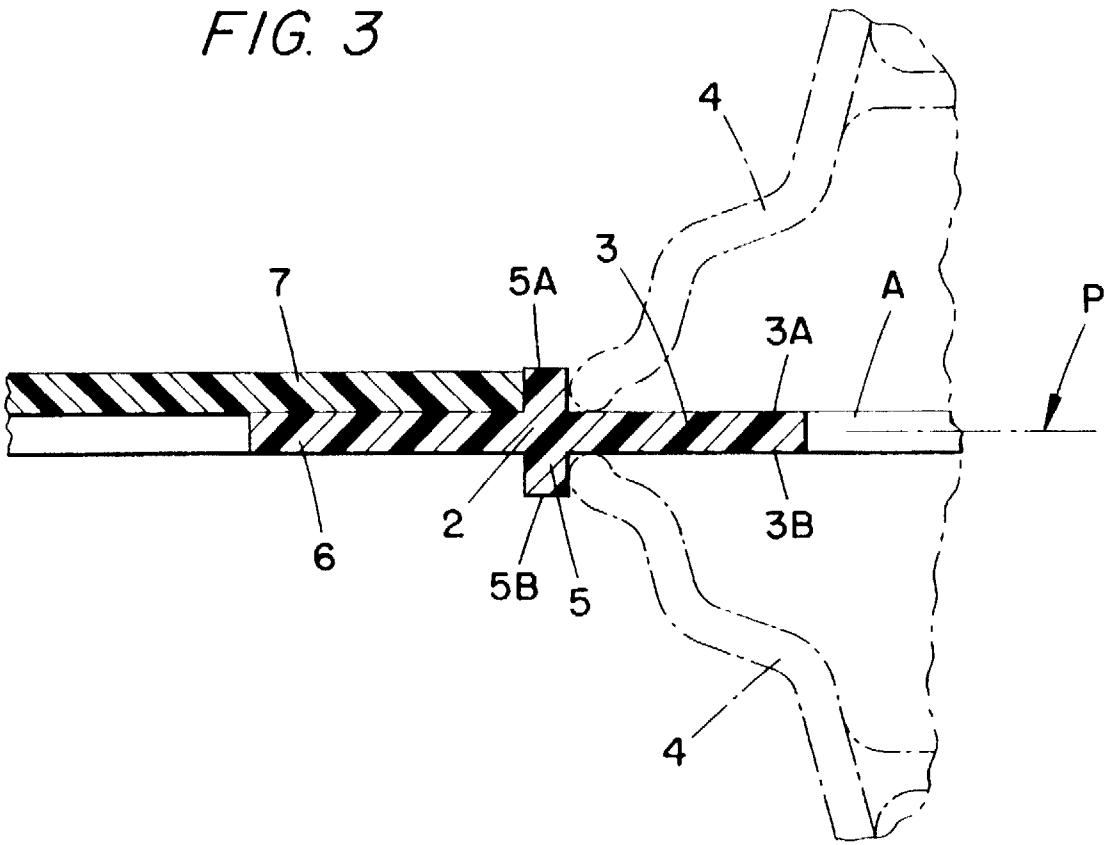
FIG. 3: a partial section on the line 3—13 in FIG. 2.

The mesh 1 that is shown in FIG. 1 comprises a plurality of rim holders 2 that are of plastic and which are joined to each other. As can be seen particularly clearly from FIG. 3, each rim holder 2 incorporates a spacer ring 3 that is arranged between wheel rims 4 that lie above each other. On the outer periphery of the circular spacer ring 3 there is a positioning edge 5, which is made in one pierce with the circular spacer ring 3 and extends upward and downwards and this centers the wheel rims 4 that lie one above the other and prevents any relative displacement between the wheel rims. That is, the positioning edge includes upper and lower portions 5A, 5B; which project upwardly and downwardly, respectively, with reference to a center plane P defined by the holder 2. Each of the portions 5A, 5B defines the outer periphery of a wheel rim receiving area. The spacer ring defines upwardly and downwardly facing surfaces 3A, 3B projecting inwardly toward a center of the wheel rim-receiving area to define a center aperture A lying in the plane P.

Figure 2:
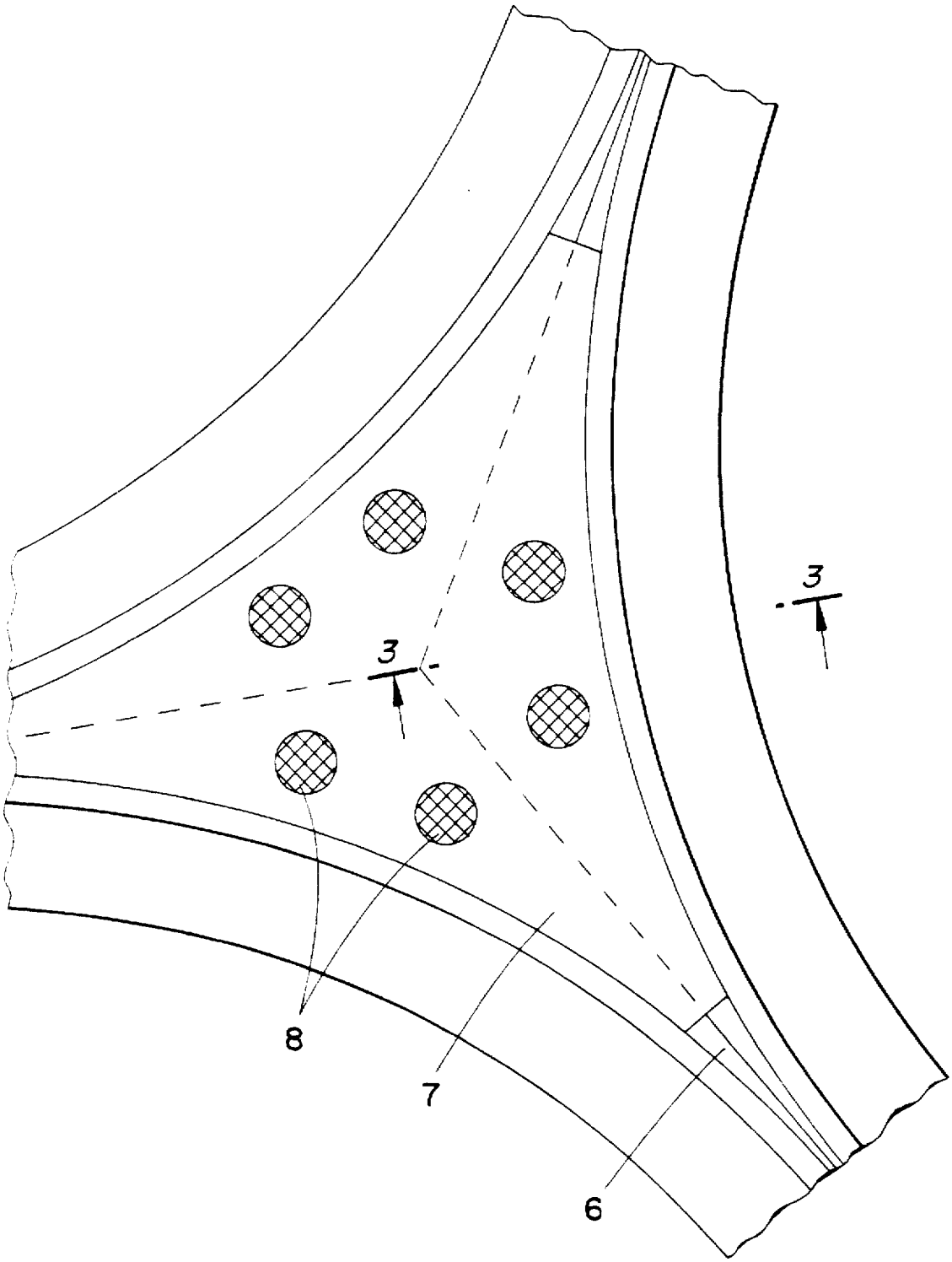
FIG. 2: an enlarged view of the connector point between adjacent rim holders as in FIG. 1.

At least at several points on their peripheries; the rim holders 2 incorporate a flange edge 6 that extends outwards beyond the positioning edge 5. In the embodiment that is shown, the flange edge 6 forms a hexagon. All of the rim holders 2 are connected together in a honeycomb arrangement (FIG. 1) to form a mesh. The connection of each three adjoining rim holders 2 is effected by means of a wedge-shaped connector 7 that is of plastic; this overlaps the flange edges 6 of the adjacent rim holders 2 and is welded to these at weld points 8 that are indicated in FIG. 2 as cross-hatched areas. The rim holders 2 and the connector 7 consist of heat-weldable plastic.

Figure 4:
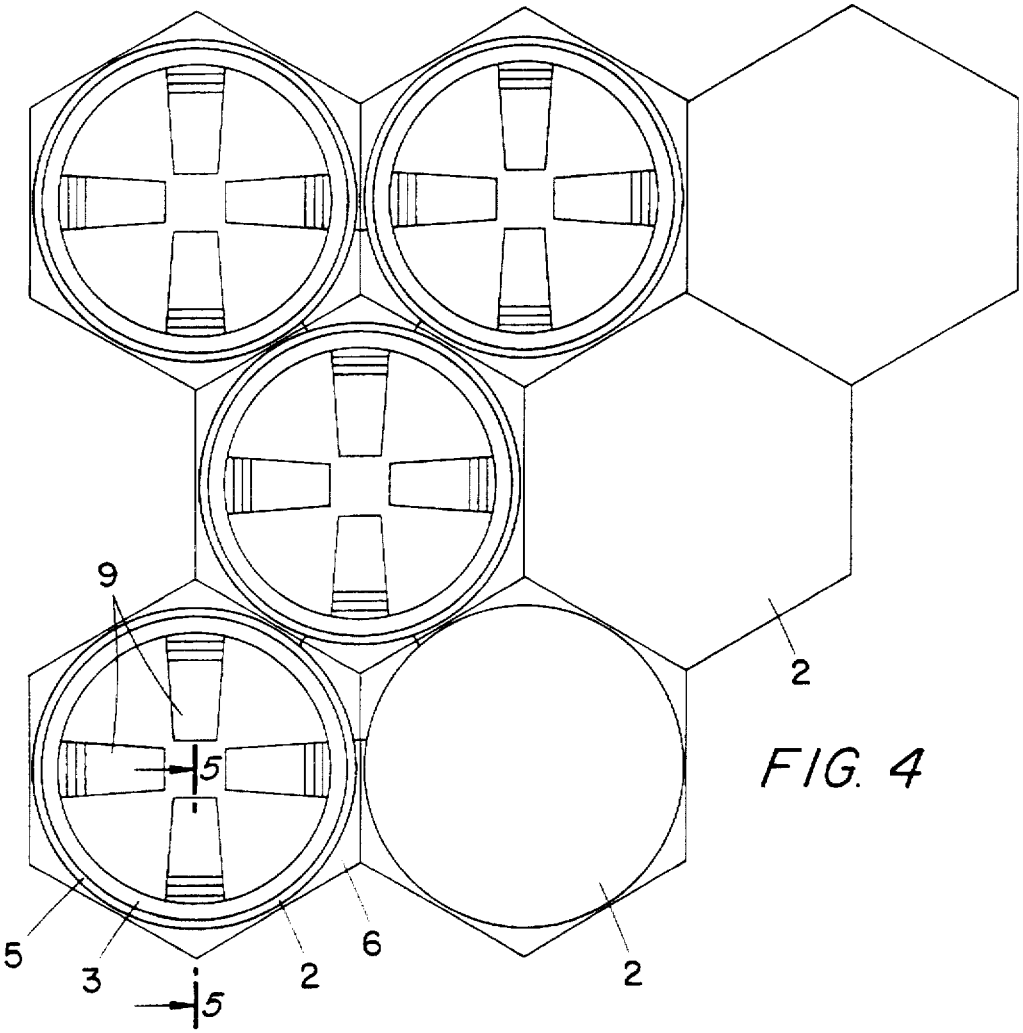
FIG. 4: plan view as in FIG. 1 for a modified embodiment.
Figure 5:
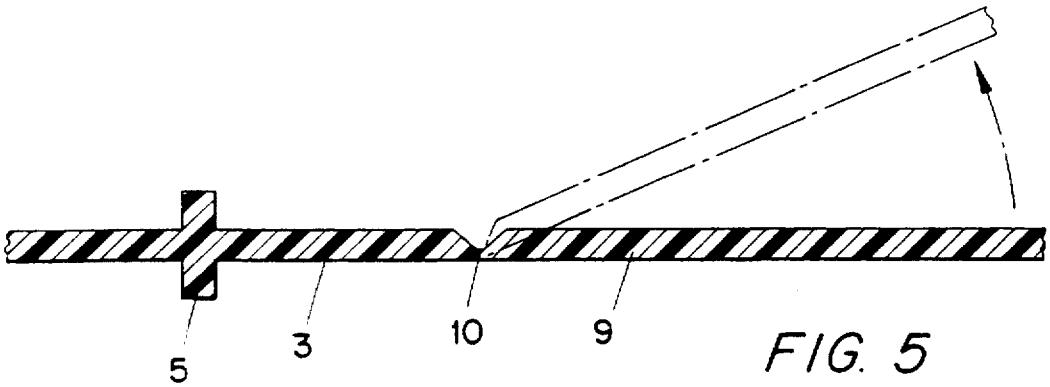
FIG. 5: an enlarged cross-section along the line 5—5 in FIG. 4

FIGS. 4 and 5 show an embodiment in which a plurality of protective tabs 9 extend radially inwards from the circular spacer ring 3. Each of the protective tabs 9 are connected flexibly through a film hinge 10 to the circular spacer ring 3 and can be bent or bowed out of the plane of the intermediate spacer ring 3, as is shown by the dashed line in FIG. 5. The protective tabs 9 serve to protect the center section of a rim (wheel dish) that is bowed axially beyond the wheel rim edge.

In place of the hexagonal version that is shown in FIG. 1, the edge flange 6 can be in the form of a square. All of the rim holders 2 are then connected to each other in a right angle arrangement to form a mesh. In place of the embodiment that is shown in which the intermediate spacer ring 3 and the positioning edge 5 each extend continuously around the periphery of the rim holder 2, the intermediate spacer ring 3 and/or the positioning edge 5 can be interrupted, i.e., made with breaks, as long as the functions of retaining the spacing between wheel rim edges that lie above each other and the centring of the wheel rims are retained.

I claim:

1. A spacer rack for stacking wheel rims, comprising a plurality of plastic rim holders each defining a center plane; a positioning edge including upper and lower portions projecting upwardly and downwardly with respect to said center plane, each of said upper and lower portions defining an outer periphery of a wheel rim-receiving area; an upwardly facing spacer surface and a downwardly facing spacer surface projecting inwardly from said upper and lower portions, respectively, toward a center of said area for separating a pair of stacked wheel rims, said center planes of all said rim holders coinciding with one another; said rim holders being interconnected at their outer peripheries to form a mesh, some of said rim holders being connected to more than four other rim holders.

2. The spacer rack according to claim 1, wherein said upwardly and downwardly facing surfaces are formed on a spacer element lying in said center plane.

3. The spacer rack according to claim 2, wherein said upper and lower portions and said spacer element extend uninterruptedly around said periphery of said rim-receiving area.

4. The spacer rack according to claim 3, wherein said upper and lower portions extend annularly to define circular wheel rim-receiving areas.

5. The spacer rack according to claim 2, wherein said spacer element is ring-shaped.

6. The spacer rack according to claim 1, wherein each rim holder includes a flange structure extending outwardly from said rim edge and lying in said center plane, said flange structure defining said outer periphery of said rim holder.

7. The spacer rack according to claim 6 further including connectors interconnecting said rim holders, each connector overlapping the flange structures of at least two rim holders.

8. The spacer rack according to claim 7, wherein said connectors are formed of plastic arid are welded to said flange structures.

9. The spacer rack according to claim 6, wherein each flange structure is hexagonal to define a connection for six other rim holders to form a honeycomb arrangement.

10. The spacer rack according to claim 2, wherein said spacer element forms a center aperture lying in said center plane.

11. The spacer rack according to claim 10, further including a plurality of protective tabs extending inwardly from said spacer element of each rim holder.

12. The spacer rack according to claim 11, wherein each protective tab is flexibly connected to said spacer element by an integral film hinge.

13. The spacer rack according to claim 1 wherein each of said rim holders has a hexagonal outer periphery, whereby the rim holders form a honeycomb arrangement.

* * * * *